US007189059B2

(12) United States Patent
Barton et al.

(10) Patent No.: US 7,189,059 B2
(45) Date of Patent: Mar. 13, 2007

(54) COMPRESSOR INCLUDING AN ENHANCED VANED SHROUD

(75) Inventors: Michael T. Barton, Scottsdale, AZ (US); Donald L. Palmer, Cave Creek, AZ (US); Mahmoud L. Mansour, Phoenix, AZ (US); Don F. Durschmidt, Chandler, AZ (US); John A. Gunaraj, Chandler, AZ (US); Mark D. Matwey, Phoenix, AZ (US); John A. Slovisky, Chandler, AZ (US); Nick A. Nolcheff, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 123 days.

(21) Appl. No.: 10/976,934

(22) Filed: Oct. 27, 2004

(65) Prior Publication Data

US 2006/0088412 A1 Apr. 27, 2006

(51) Int. Cl.
*F04D 29/44* (2006.01)

(52) U.S. Cl. ..... 415/186; 415/191

(58) Field of Classification Search ..... 415/185, 415/186, 191, 192
See application file for complete search history.

(56) References Cited

U.S. PATENT DOCUMENTS 3,887,295 A * 6/1975 Yu ..... 415/116
3,893,787 A 7/1975 Jones
4,195,473 A 4/1980 Aspinwall
4,212,585 A * 7/1980 Swarden et al. ..... 415/58.6
4,594,052 A 6/1986 Niskanen
4,687,412 A 8/1987 Chamberlain
4,930,978 A * 6/1990 Khanna et al. ..... 415/58.3
5,236,301 A 8/1993 Palmer
5,263,816 A 11/1993 Weimer et al.
5,277,541 A 1/1994 Palmer
5,304,033 A 4/1994 Tang
5,375,974 A 12/1994 Heinrich
5,403,149 A 4/1995 Arnet et al.
6,394,751 B1 5/2002 Daudel et al.

* cited by examiner

*Primary Examiner*—Edward K. Look
*Assistant Examiner*—Nathan Wiehe
(74) *Attorney, Agent, or Firm*—Ingrassia Fisher & Lorenz

(57) ABSTRACT

A compressor includes an enhanced vaned shroud and is configured such that the flow area ratio is equivalent to that of a conventional, non-vaned shroud. The vaned shroud includes a plurality of airfoils that vary in thickness to obtain desired vibrational mode shapes and natural frequencies. A stiffening ring of limited axial extent is coupled to, and between, the airfoils, and the shroud is manufactured with a section of constant radius.

26 Claims, 6 Drawing Sheets

COMPRESSOR INCLUDING AN ENHANCED VANED SHROUD

This invention was made with Government support under Contract Number DAA-H10-02-2-0003 awarded by the U.S. Army. The Government has certain rights in this invention.

TECHNICAL FIELD

The present invention relates to compressors and, more particularly, to a compressor that includes an enhanced vaned shroud.

BACKGROUND

Aircraft main engines not only provide propulsion for the aircraft, but in many instances may also be used to drive various other rotating components such as, for example, generators, compressors, and pumps, to thereby supply electrical, pneumatic, and/or hydraulic power. However, when an aircraft is on the ground, its main engines may not be operating. Moreover, in some instances the main engines may not be capable of supplying power. Thus, many aircraft include one or more auxiliary power units (APUs) to supplement the main propulsion engines in providing electrical and/or pneumatic power. An APU may additionally be used to start the main propulsion engines.

An APU is, in most instances, a gas turbine engine that includes a combustor, a power turbine, and a compressor. During operation of the APU, compressor draws in ambient air, compresses it, and supplies compressed air to the combustor. The combustor receives fuel from a fuel source and the compressed air from the compressor, and supplies high energy compressed air to the power turbine, causing it to rotate. The power turbine includes a shaft that may be used to drive the compressor. In some instances, an APU may additionally include a starter-generator, which may either drive the turbine or be driven by the turbine, via the turbine output shaft. Some APUs additionally include a bleed air port between the compressor section and the turbine section. The bleed air port allows some of the compressed air from the compressor section to be diverted away from the turbine section, and used for other functions such as, for example, main engine starting air, environmental control, and/or cabin pressure control.

Although most APUs, such as the one generally described above, are robust, safe, and generally reliable, some APUs do suffer certain drawbacks. For example, when some APUs are operated at part power, the surge margin of the APU compressor, or at least one or more stages of the compressor, can be reduced. At part power conditions, the compressor flow rate is reduced, but the compressor is sized to deliver the required high-speed flow rate. When the compressor is operated at reduced speed and power conditions (e.g., at specific-fuel-consumption (SFC)-critical, part-speed, part-power conditions), the impeller blade leading edge will be operating at high incidence angles. This dramatically reduces compressor efficiency and surge margin at part power.

One approach to improving SFC-critical, part-speed, part-power surge margin and overall efficiency is to include a plurality of vanes (or airfoils) within the compressor shroud. Such a vaned shroud is disclosed in U.S. Pat. No. 5,277,541, which is assigned to the assignee of the present invention, and achieves the function of a variable flow capacity impeller. The disclosed vaned shroud may be desirable because it is passive in function. It also provides significant surge margin increase, eliminates the need for surge bleed and/or variable geometries, and lowers recirculation losses as compared to a conventional ported shroud design. However, the disclosed vaned shroud does not include various features that further improve overall surge margin and efficiency.

Hence, there is a need for an vaned shroud that further improves the surge margin, and overall operational efficiency, of a compressor as compared to presently known vaned shrouds. The present invention addresses one or more of these needs.

BRIEF SUMMARY

In one embodiment, and by way of example only, a compressor includes a housing, an impeller, a shroud, and a plurality of spaced apart airfoils. The impeller is rotationally mounted within the housing and has a plurality of impeller blades. At least a portion of the impeller defines an inducer having an inducer area ratio. The shroud at least partially surrounds at least a portion of the impeller, and includes at least an inner peripheral surface displaced radially outwardly of the impeller. The airfoils are coupled to, and extend radially inwardly from, the shroud inner peripheral surface. The inducer area ratio is substantially equivalent to that of a compressor having a shroud without the plurality of spaced apart airfoils.

In another exemplary embodiment, a centrifugal compressor shroud includes a main body and a plurality of airfoils. The main body has a first side, a second side, and an inner surface defining a flow passage between the first and second sides. The airfoils extend into the main body flow passage, and each has at least a first end and a second end. Each airfoil first end is coupled to the main body inner surface and has a first thickness, each airfoil second end extends into the main body flow passage and has a second thickness, and the first thickness is greater than the second thickness.

In yet another exemplary embodiment, a centrifugal compressor shroud includes a main body and a plurality of spaced apart airfoils. The main body has a first side, a second side, and an inner surface defining a flow passage between the first and second sides. The shroud inner surface includes a constant-radius-section of a predetermined axial length disposed between the first and second sides that has a substantially constant radius along the predetermined axial length. The airfoils are coupled to, and extend radially inwardly from, the constant-radius-section.

In still another exemplary embodiment, a method of designing a vaned shroud for a compressor having an impeller with main blades and splitter blades, in which the vaned shroud has a number of airfoils extending from an inner surface thereof, includes the steps of determining an inducer area ratio for a conventional, non-vaned shroud compressor, a radial extent for each of the airfoils, the number of airfoils, axial positions for each of the determined number of airfoils radially around the shroud inner surface, and dimensioning the compressor such that the compressor will have a restored inducer area ratio. The restored inducer area ratio being substantially equivalent to that of the determined inducer area ratio for the conventional, non-vaned shroud compressor.

Other independent features and advantages of the preferred devices and methods will become apparent from the following detailed description, taken in conjunction with the accompanying drawings which illustrate, by way of example, the principles of the invention

DETAILED DESCRIPTION OF A PREFERRED EMBODIMENT

Before proceeding with a detailed description, it is to be appreciated that the described embodiment is not limited to use in conjunction with a particular type of turbine engine or particular type of compressor. Thus, although the present embodiment is, for convenience of explanation, depicted and described as being implemented in a single-stage centrifugal compressor, and in an auxiliary power unit, it will be appreciated that it can be implemented as various other types of compressors, engines, turbochargers, and various other fluid devices, and in various other systems and environments.

Figure 1:
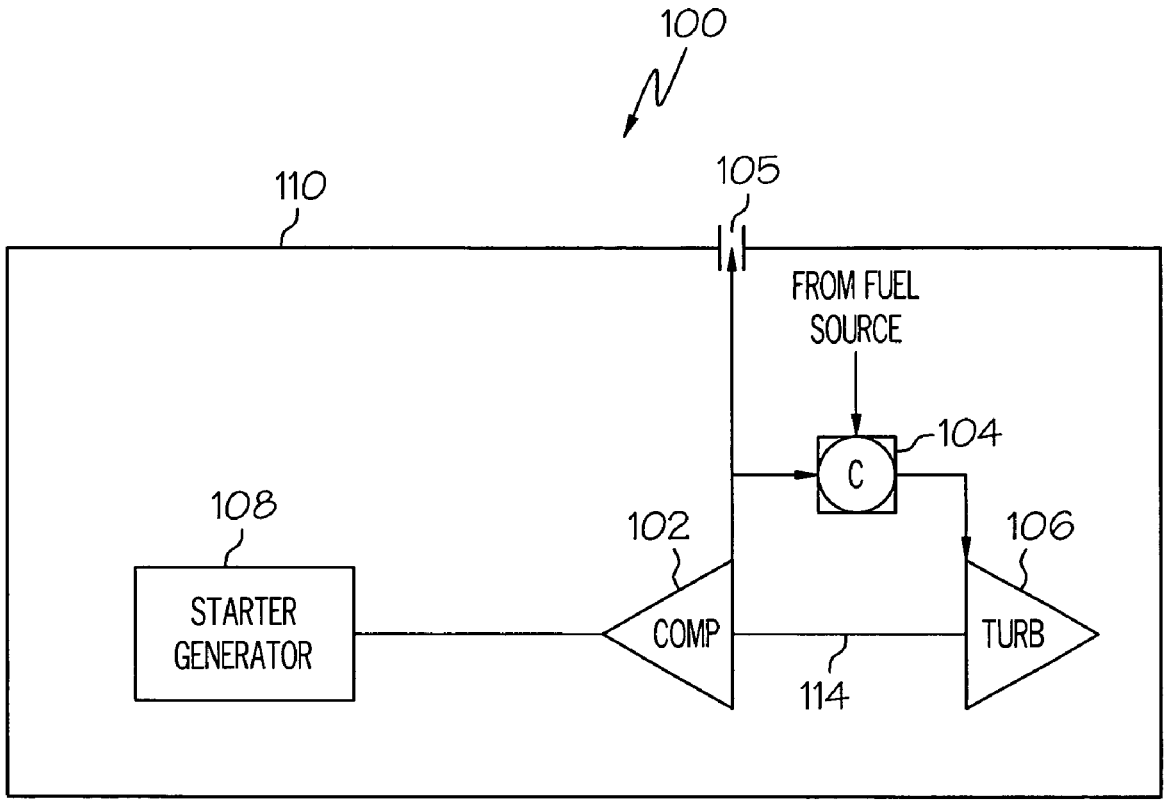
FIG. 1 is a schematic representation of an auxiliary power unit (APU) according to an exemplary embodiment of the present invention.

Turning now to the description, and with reference first to FIG. 1, an embodiment of an exemplary auxiliary power unit (APU) 100 is shown in simplified schematic form. The APU 100 includes a compressor 102, a combustor 104, a turbine 106, and a starter-generator unit 108, all preferably housed within a single containment housing 110. During operation of the APU 100, the compressor 102 draws ambient air into the containment housing 110. The compressor 102 compresses the ambient air, and supplies a portion of the compressed air to the combustor 104, and may also supply compressed air to a bleed air port 105. The bleed air port 105, if included, is used to supply compressed air to a non-illustrated environmental control system. It will be appreciated that the compressor 102 may be any one of numerous types of compressors now known or developed in the future. In a particular preferred embodiment, however, the compressor is a single-stage centrifugal compressor, an embodiment of which is described in more detail further below.

The combustor 104 receives the compressed air from the compressor 102, and also receives a flow of fuel from a non-illustrated fuel source. The fuel and compressed air are mixed within the combustor 104, and are ignited to produce relatively high-energy combustion gas. The combustor 104 may be implemented as any one of numerous types of combustors now known or developed in the future. Non-limiting examples of presently known combustors include various can-type combustors, various reverse-flow combustors, various through-flow combustors, and various slinger combustors.

No matter the particular combustor configuration 104 used, the relatively high-energy combustion gas that is generated in the combustor 104 is supplied to the turbine 106. As the high-energy combustion gas expands through the turbine 106, it impinges on the turbine blades (not shown in FIG. 1), which causes the turbine 106 to rotate. It will be appreciated that the turbine 106 may be implemented using any one of numerous types of turbines now known or developed in the future including, for example, a vaned radial turbine, a vaneless radial turbine, and a vaned axial turbine. In a particular preferred configuration, several embodiments of which are described further below, the turbine 106 is implemented as a vaneless radial turbine. No matter the particular type of turbine that is used, the turbine 106 includes an output shaft 114 that drives the compressor 102. Moreover, depending on the mode in which the APU 100 is operating, the turbine 106, via the output shaft 114, may also drive the starter-generator unit 108, or alternatively the turbine 106 may be driven by the starter-generator unit 108.

Turning now to FIGS. 2–10, a more detailed description of the compressor 102 and the various components of which the compressor 102 is constructed will be provided. In the depicted embodiment, the compressor 102 is a single-stage centrifugal compressor and includes an impeller 206, a diffuser 208, and a shroud 210. It will be appreciated, however, that the compressor 102 could be implemented as a multi-stage centrifugal compressor. In any case, the impeller 206 is mounted on the output shaft 114, via a hub 212, and is thus rotationally driven by either the turbine 106 or the starter-generator 108, as described above.

Figure 2:
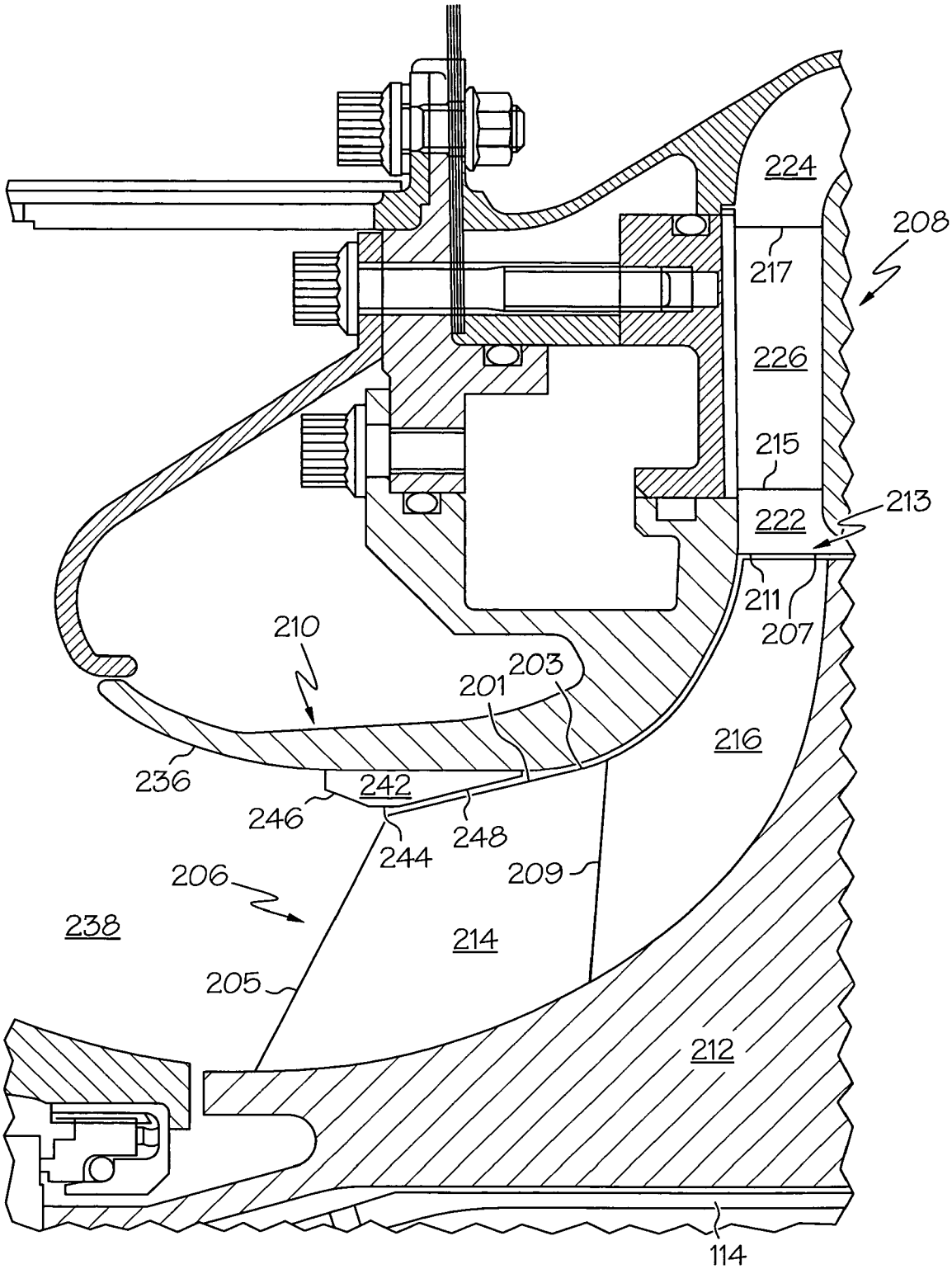
FIG. 2 is a cross section view of a portion of a compressor that may be used in the APU of FIG. 1.
Figure 3:
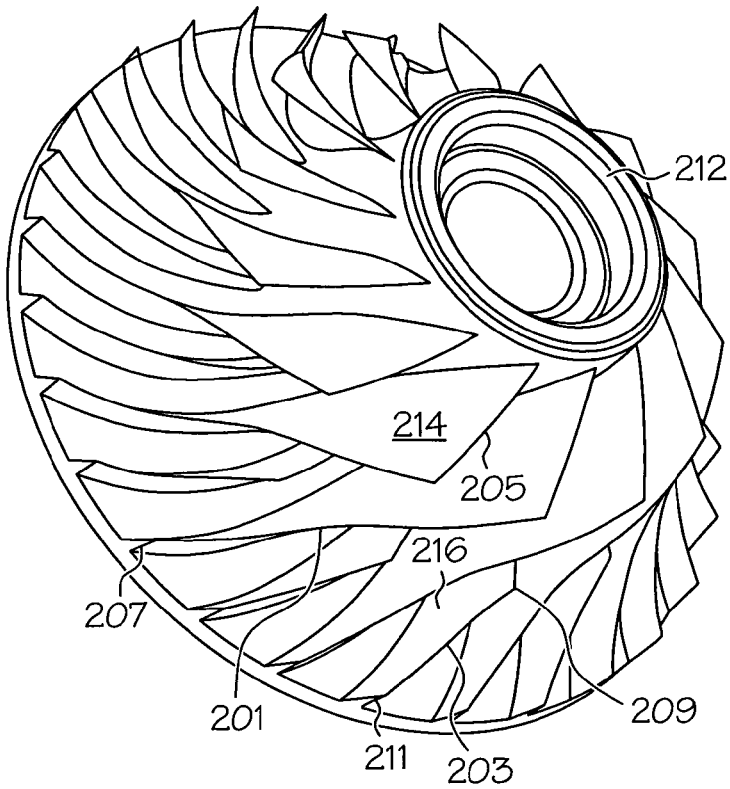
FIG. 3 is a perspective view of an exemplary impeller that may be used in the compressor of FIG. 2.

In the depicted embodiment, and as is shown more clearly in FIG. 3, the impeller 206 includes a plurality of spaced-apart main blades 214 and a plurality of interposed splitter blades 216. It will be appreciated that this is merely exemplary of a particular physical embodiment, and that the impeller 206 could also be implemented as a full-bladed impeller, which does not include splitter blades 216, or a mixed-flow impeller. The main blades 214 and splitter blades 216 each extend both generally radially and axially from the hub 212 to blade tips 201 and 203, respectively. The main blades 214 and splitter blades 216 additionally each include a leading edge 205 and 209, respectively, and a trailing edge 207 and 211, respectively. As is generally known, the main blades 214 are longer than the splitter blades 216 and thus, as is shown most clearly in FIG. 2, the main blade leading edges 205 and the splitter blade leading edges 209 do not have the same axial extent. Conversely, the main blade and splitter blade trailing edges 207, 211 do have the same radial extent, and thus define an impeller trailing edge 213, from which high velocity air is discharged and directed into the diffuser 208.

The diffuser 208 is disposed adjacent to, and surrounds a portion of, the impeller 206, and includes an air inlet 222 and an air outlet 224. In the depicted embodiment, the diffuser 208 is a radial vaned diffuser, and thus further includes a plurality of diffuser vanes 226. However, it will be appreciated that the diffuser 208 could be implemented as any one of numerous other diffusers, including a vaneless radial diffuser. The diffuser vanes 226 are arranged substantially tangential to the main and splitter blade trailing edges 207, 211 and, similar to the main blades 214 and splitter blades 216, each includes a leading edge 215 and a trailing edge 217. As shown in FIG. 2, the diffuser air inlet 222 is in fluid communication with the main and splitter blade trailing edges 207, 211. Thus, relatively high velocity air discharged from the impeller 206 flows into and through the diffuser air inlet 222. As the air flows through the diffuser 208, the diffuser 208 reduces the velocity of the air and increases the pressure of the air to a higher magnitude.

Figure 4:
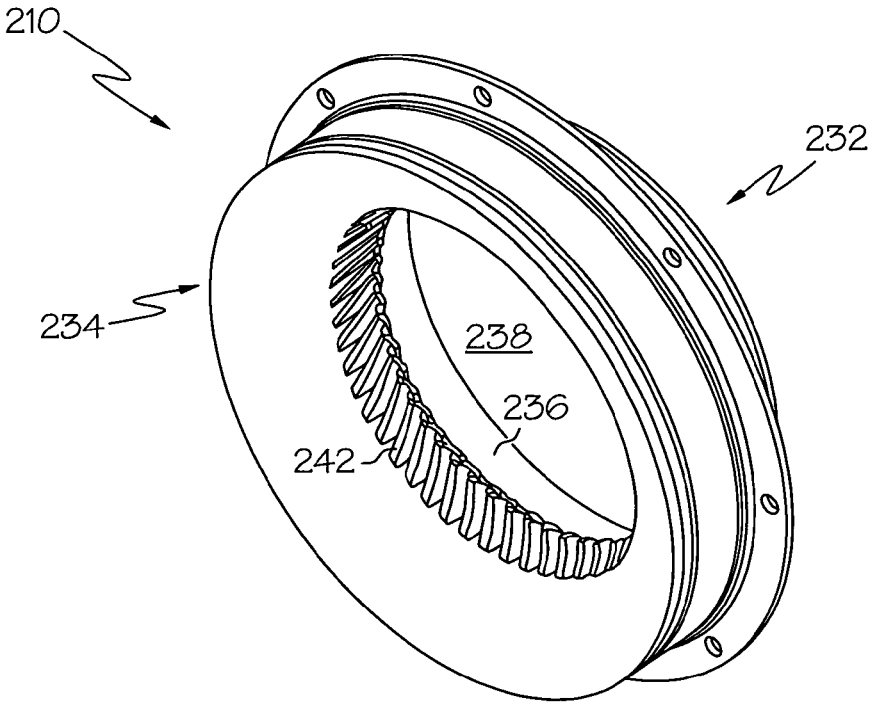
FIGS. 4 and 5 are perspective and end views, respectively, of an exemplary embodiment of a shroud that may be used in the compressor of FIG. 2
Figure 5:
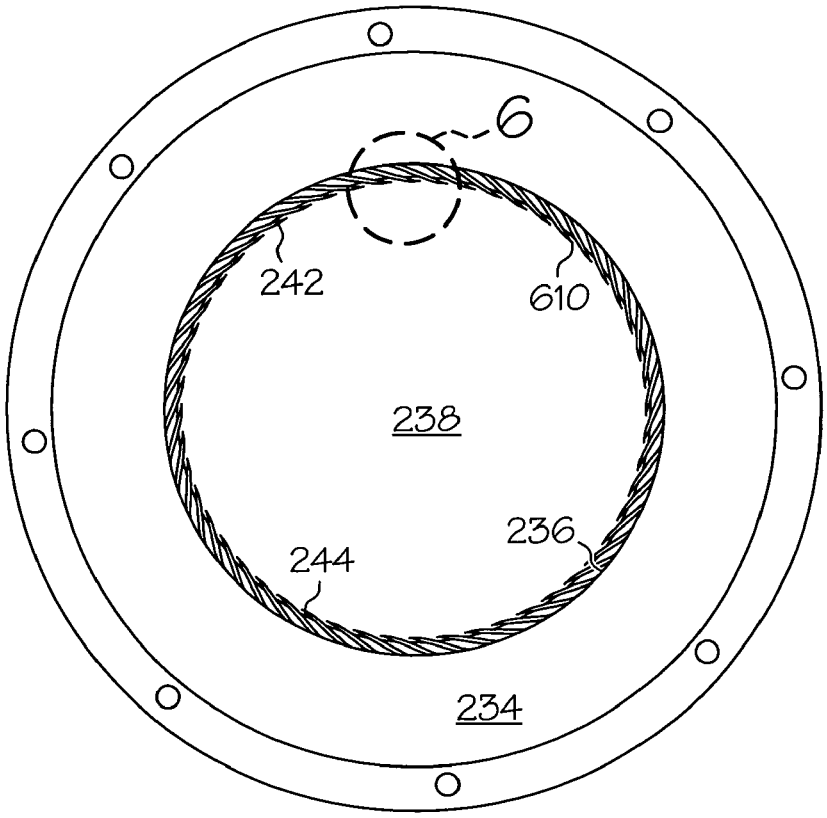
Figure 7:
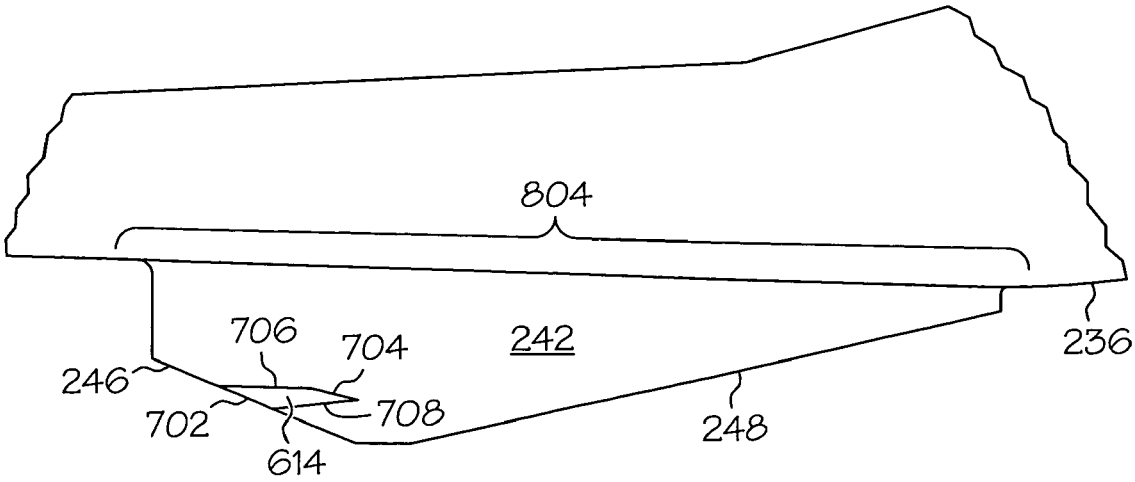
FIG. 7 is a close up cross section view of a portion of the shroud shown in FIGS. 5 and 6 showing a side view of the airfoils included in the shroud in more detail.

Turning now to a description of the shroud 210, reference should be made, in addition to FIG. 2, to FIGS. 4 and 5, which depict an end view and a perspective view of a particular physical embodiment of the shroud 210, respectively. The shroud 210 is disposed adjacent to, and partially surrounds, the main blades 214 and splitter blades 216. The shroud 210, among other things, cooperates with an annular inlet duct 238 to direct the air that is drawn into the APU 100 by the compressor 102 into the impeller 206. As such, the shroud 210 includes a fluid inlet 232, a fluid outlet 234, and an inner surface 236 that defines a flow passage 238. As is generally known, when the impeller 206 is rotated, the blades 214, 216 draw air into and through the shroud flow passage 238 and into the impeller 206, which increases the velocity of the air to a relatively high velocity. The relatively high velocity air is then discharged from the impeller trailing edge 213, into above-described the diffuser 208.

When a compressor 102, such as the one described above, is operated at reduced speed and part-power conditions, the main blade leading edges 205 may be operating at relatively high incidence angles, which can dramatically reduce both compressor efficiency and surge margin at part power conditions. To alleviate these drawbacks, the shroud 210 additionally includes a plurality of spaced apart vanes or airfoils 242. As such, the shroud 210 is referred to herein as a "vaned shroud." Each airfoil 242 is coupled to the shroud inner surface 236, and extends generally radially inwardly therefrom to an airfoil tip 244. The airfoil tips 244 are disposed in the shroud flow passage 238 and are closely spaced a predetermined distance from each of the impeller main blade tips 201. The airfoils 242each include a leading edge 246 and a trailing edge 248.

Figure 6:
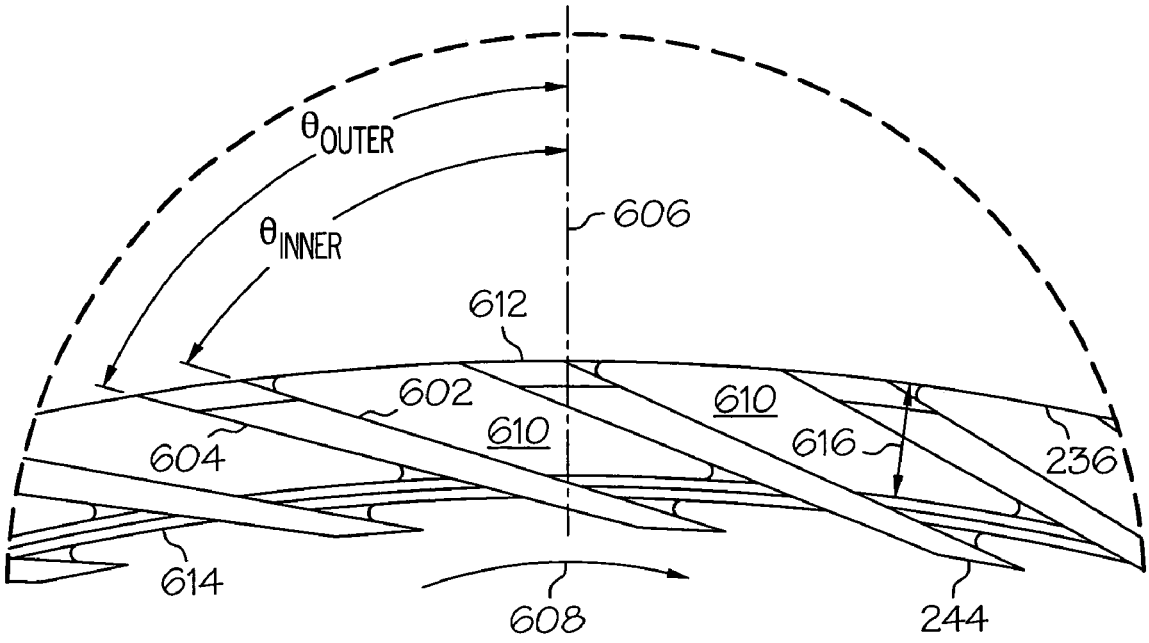
FIG. 6 is a close up cross section view of that portion of the shroud of FIGS. 4 and 5 that is encircled in FIG. 5.
Figure 8:
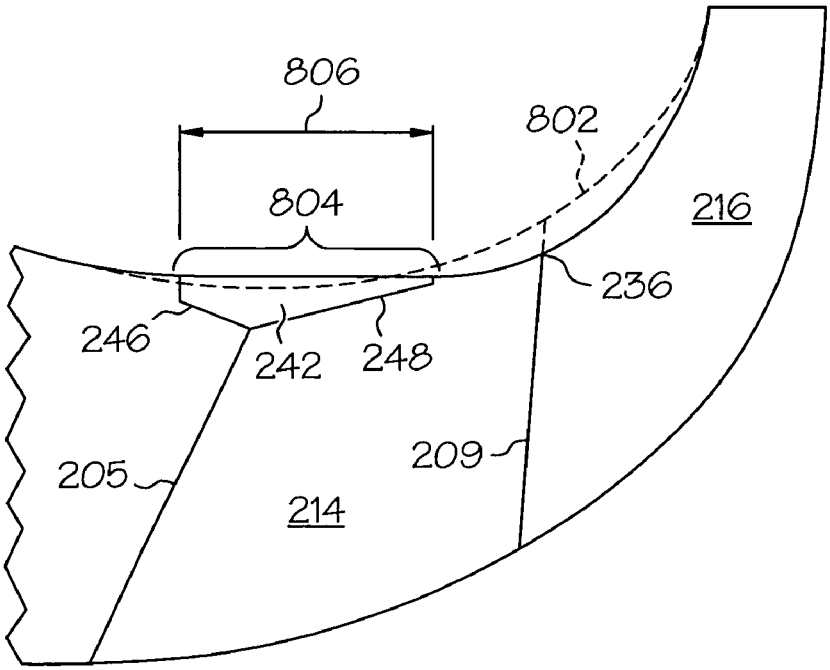
FIG. 8 is a simplified cross section view of the compressor shown in FIG. 2 illustrating shroud contour comparisons between various shroud designs.
Figure 9:
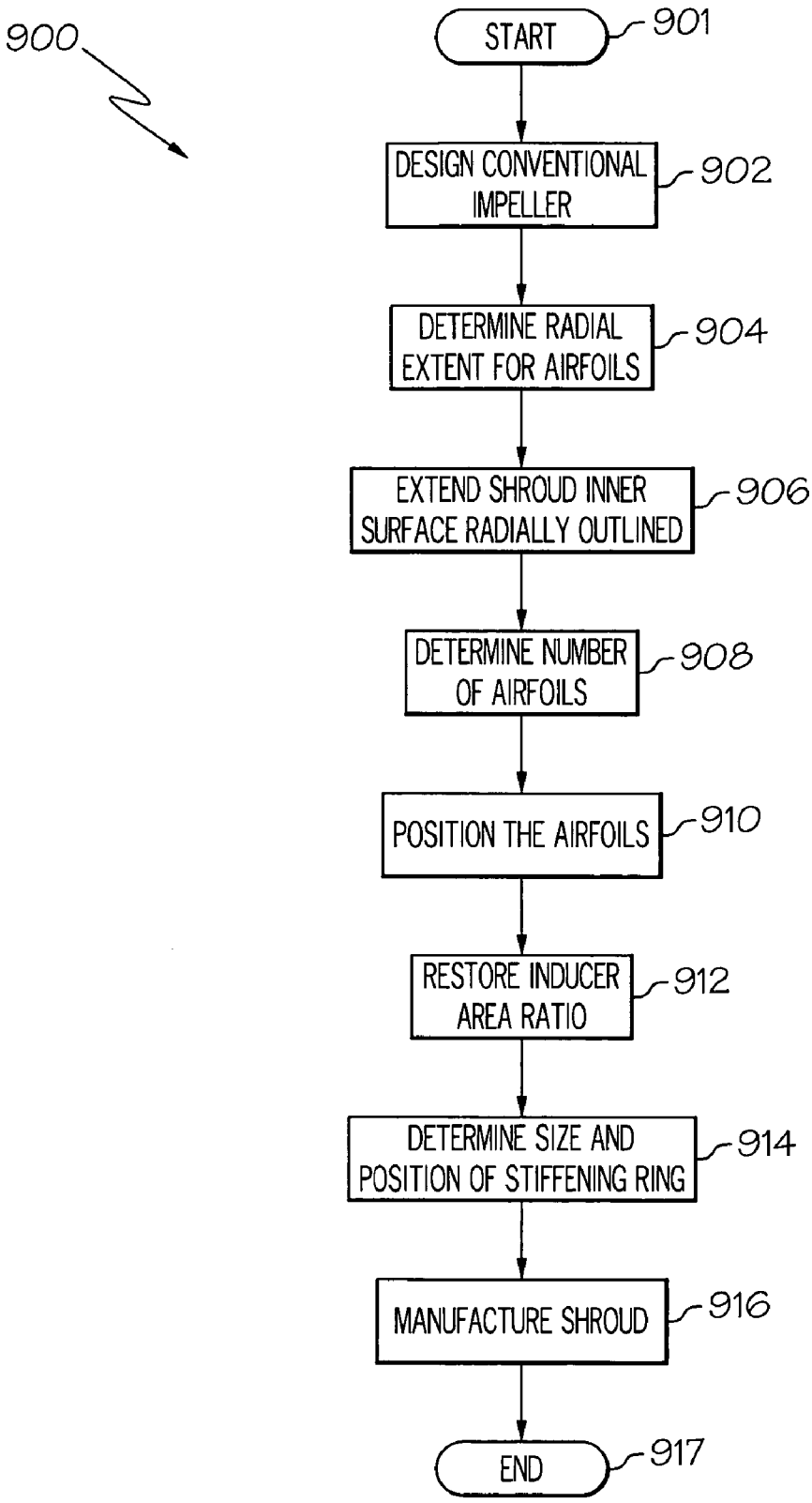
FIG. 9 is a flowchart depicting an exemplary design optimization process according to an embodiment of the present invention.

With reference to FIG. 6, which is a view of that portion of the vaned shroud 210 labeled 6—6 in FIG. 5, a particular preferred configuration of the airfoils 242 will now be described. The airfoils 242 each include an inner side 602, which is the side that faces the shroud inner surface 236, and an opposed outer side 604. The airfoils 242 extend from the shroud inner surface 236 and are preferably positioned so that the point of lowest radial extent is centered over the main blade impeller leading edge 205 (not shown in FIG. 6). Moreover, the airfoils each extend from the shroud inner surface 236 such that the airfoil inner 602 and outer 604 surfaces each make an angle ($\theta_{inner}$, $\theta_{outer}$) relative to a reference line 606, and in the direction of impeller rotation, which is represented by arrow 608. The angles ($\theta_{inner}$, $\theta_{outer}$) may vary to achieve desired compressor performance, but in a particular preferred embodiment the angles ($\theta_{inner}$, $\theta_{outer}$) are about 65-degrees and 67-degrees, respectively. This configuration of the airfoils 242 will augment airflow into the impeller 206 at high rotational speeds, while at part-power conditions this configuration discourages airflow out of the impeller 206.

Though not depicted, it will be appreciated that the airfoils 242 may also be twisted in an axial direction that is generally normal to an axial angle of the main impeller blades 214. As such, each of the airfoils 242 crosses the associated portion of the main impeller blades 214 at a direction substantially normal thereto. This axial twisting of each airfoil 242, among other things, reduces pressure blade unloading that may occur due to air flow through flow passages 610 defined by adjacent airfoils 242.

In addition to being radially angled and axially twisted, the airfoils 242 are relatively thin and, as was previously noted and may be readily seen in FIG. 2, the airfoil tips 244 are located relatively close to the impeller main blade tips 201. It was discovered that the airfoils 242, depending on the physical configuration thereof, can exhibit one or more natural frequencies with crossing points in the compressor operating range. As a result, the airfoils 242 could be subject to impeller-induced high cycle fatigue stresses. To reduce the likelihood of these impeller-induced stresses and thereby improve the mechanical integrity of the airfoils 242, the airfoils 242 include two features, each of which will now be described in more detail.

The first of the above-noted features, as clearly shown in FIG. 6, is that the airfoils are preferably configured to vary in thickness between a first end 612 (i.e., the end that is coupled to the shroud inner surface 236) and the airfoil tip 244. This variation in thickness increases the natural frequencies of the airfoils 242 while exhibiting minimal impact on the aerodynamic performance of the compressor 102. Although the variation in thickness may be implemented in any one of numerous ways to obtain a desired compressor performance, in the preferred embodiment shown in FIG. 6, the airfoil thickness variation is implemented as a linear taper between the airfoil first ends 612 and the airfoil tips 244. For example, in the depicted embodiment, the airfoil thickness varies from a normal thickness of about 0.040" at the airfoil first ends 408 to a normal thickness of about 0.020" proximate the airfoil tips 244. It will be appreciated that numerous other airfoil configurations could be implemented to increase the natural frequencies thereof; however, the linear taper configuration is exemplary of the preferred configuration.

The second feature that is used to improve the mechanical integrity of the airfoils 242 is a stiffening ring 614. The stiffening ring 614 may be seen in FIGS. 2,4, and 5, but is most clearly depicted in FIG. 6, which should thus continue to be referenced. The stiffening ring 614 is coupled to, and between, each of the airfoils 242, and is displaced a predetermined radial distance 616 from the shroud inner surface 236. This radial distance 616 may vary and is preferably chosen to provide a desired increase in airfoil stiffness. In the depicted embodiment, the radial distance 616 is about 69% of the distance from the shroud inner surface 236 to the airfoil tip 244. In addition to this radial displacement, the stiffening ring 614 is also limited in its axial extent. That is, as is shown more clearly in FIG. 7, the stiffening ring 614 includes a leading edge 702 that is substantially aligned with the airfoil leading edges 246, and a trailing edge 704 that is disposed between the airfoil leading 246 and trailing 248 edges. Thus, the stiffening ring 614 axially extends only partially through the airfoil flow passages 610, and is fully disposed upstream of the impeller main blade leading edges 205. It was discovered that extending the stiffening ring 614 completely through the airfoil flow passages 610 to the airfoil trailing edges 248 inhibited a strong recirculation flow pattern inside the vaned shroud 210. This shroud recirculation contributes significantly to the improved performance of the compressor 102 at part-power conditions.

Mechanical analyses of the vaned shroud 210 with the tapered thickness airfoils 242 and the limited axial extent stiffening ring 614 described above shows improved airfoil mode shapes and increased airfoil natural frequencies, which together provide increased margins against impeller-induced high cycle fatigue stress across the operating range of the compressor 102. Moreover, aerodynamic analyses of the enhanced vaned shroud 210 with these features show only minimal performance degradation, most notably at the SFC-critical, part-power operating conditions, as compared to a conventional vaned shroud without these features.

In addition to the above-described features and configurations of the airfoils 242 and the stiffening ring 614, various other improvements have been made to the compressor 102 to further improve the performance exhibited by present vaned shroud compressors. For example, present vaned shroud compressors have a relatively large inducer area ratio as compared to conventional compressors having solid or ported shrouds, which results in excessive inducer diffusion and associated aerodynamic overload at part-power conditions. Before proceeding further, a brief discussion of what is meant by the terms "inducer" and "inducer area ratio" will be provided.

It is generally known that the impeller 206, at least in part, defines inducer of a compressor, and that the inducer includes an inlet and an outlet, each having a flow area. A generally accepted definition of the inducer is the inlet portion of the impeller 206, where the flow direction is predominantly axial, and less so radially. As regards inducer area ratio, it is generally known that it may be defined in any one of numerous ways, depending on the particular configuration of the compressor 102. For example, inducer area ratio can be generally defined as the physical flow area of the inducer outlet to the physical flow area of the inducer inlet. In the depicted embodiment, in which the compressor 102 is implemented to include an impeller with main blades 214 and splitter blades 216, the inducer area ratio is defined as the ratio of the physical flow area at the splitter blade leading edge plane to the physical flow area at the main blade leading edge plane.

Returning now to the description, it was discovered that, for the depicted compressor 102, the increase in inducer area ratio was due, at least in part, to a reduction in main blade leading edge height due to the airfoils, while the splitter blade leading edge heights, which are disposed downstream of the airfoils 242, remained unchanged. Thus, as will now be described, the compressor 102 depicted and described herein is configured such that its inducer area ratio is restored to a value that is substantially equivalent to that of a conventional compressor 102.

In the depicted embodiment, the inducer area ratio of the compressor 102 is restored by re-contouring a portion of the shroud inner surface 236. More specifically, and with reference now to FIG. 8, a simplified cross section view of a portion of the compressor 102 is shown, which compares the shroud inner surface contour 802 (shown with dotted lines) of a conventional compressor to the contour of the vaned shroud inner surface 236 of the present invention. As shown therein, the contour of the vaned shroud inner surface 236 results in a reduced splitter blade leading edge height, which in turn reduces the inducer area ratio to a value that is substantially equivalent to that of a conventional compressor. It will be appreciated that the inducer area ratio of the compressor 102 can be reduced in any one of numerous ways, and is not limited to a re-contour of the vaned shroud inner surface 236. For example, in addition to or instead of the inner surface re-contour, the impeller hub 212 could be re-contoured, the blade angle of either or both the main blades 214 and splitter blades 216 could be changed, or the thickness of either or both the main blades 214 and splitter blades 216 could be changed.

No matter the specific way that is used to reduce the inducer area ratio, analyses show that the reduced inducer area ratio provides significant performance improvements (in terms of pressure ratio, efficiency, and surge margin) relative to a conventional shroud at part-power conditions. For example, analyses of the depicted embodiment show that pressure ratio increases by about 15%, that impeller efficiency increases by about 3 points, and that surge margin increases. Moreover, analyses show that the reduced inducer area ratio provides improved internal flow field conditions relative to a conventional shroud. This improved internal flow field translates to relatively lower blockage and relatively lower loss generation.

In addition to each of the performance-improving features described above, the vaned shroud 210 additionally includes various features that allow the vaned shroud 210 to be manufactured at a relatively low cost as compared to presently known vaned shrouds. For example, with continued reference to FIG. 8, it is seen that the shroud inner surface 236 is further contoured to include a section 804 of constant radius. This constant-radius section 804 is disposed between the airfoil leading 246 and trailing 248 edges, and has a predetermined axial length 806. In the depicted embodiment, the axial length 806 is about equivalent to the length of the airfoil flow passages 610. However, it will be appreciated that the axial length 806 could be larger or smaller than this value. No matter the specific value of the axial length 806, this feature allows a relatively low-cost, EDM (electrostatic discharge machining) process, which cuts fairly quickly and efficiently along straight edges, to be used to machine the airfoil flow passages 406.

The stiffening ring 614 is also configured to permit its fabrication using EDM. More specifically, and with reference once again to FIG. 7, it is seen that the depicted stiffening ring leading 702 and trailing 704 edges are each substantially straight and faceted, and that the stiffening ring leading edge 702 is slightly longer than the stiffening ring trailing edge 704. In addition, the outer peripheral surface 706 of the stiffening ring 614, which is the surface that faces the vaned shroud inner surface 236, is substantially straight and extends substantially parallel to the vaned shroud constant radius section 804. However, while the stiffening ring inner peripheral surface 708 is also substantially straight, because the stiffening ring leading 702 and trailing 704 edges have differing lengths, it is not parallel to the vaned shroud constant radius section 804.

The vaned shroud 210 described above may be designed and manufactured in accordance with any one of numerous design and manufacturing methods, processes, and/or algorithms. However, a particular preferred design optimization process 900 for the vaned shroud 210 is depicted in flowchart form in FIG. 9, and will now be described. Before doing so, it should be noted that the parenthetical reference numerals in the following description correspond to like reference numerals that are used to reference the flowchart blocks in FIG. 9. It will additionally be appreciated that although the process 900 is, for convenience, described using a particular order of steps, the process 900 could also be preformed in a different order than what is described below.

The first step in the depicted process 900 is to complete the detailed aerodynamic and mechanical design of a conventional impeller (902). In other words, an impeller 206 that may be implemented in a conventional non-vaned-shroud compressor. Preferably, though not necessarily, the impeller 212 is designed with high front end loading for reduced clearance sensitivity, high back sweep angle for good efficiency and surge margin, and includes splitter blades 216 for reduced clearance sensitivity. It will be appreciated that this first step (902) may be bypassed if the vaned shroud 210 that is being designed is not for a new compressor design, but is instead being implemented as a back-fit for an existing compressor design.

Once a baseline impeller 206 has been determined, either by new design or based on the use of a back-fit design, the size and radial extent of the vaned shroud airfoils 242 is selected (904), and the shroud inner surface 236 is also extended radially outwardly (906). The airfoil radial extent is selected (904) to provide the desired surge margin benefit. Analytical tools are available that utilize state-of-the-art computational fluid dynamics analysis techniques to model the vaned shroud 210 and its airfoils 242, and may be used to determine the desired radial extent. The shroud inner surface 236 is extended radially outwardly (906) to compensate for the reduced inlet flow area resulting from the blockage due to the airfoils 242.

In addition to the size and radial extent, the number of airfoils 242 is also selected (908). Preferably, the number is selected to provide reasonable overlap between adjacent airfoils 242. It will be appreciated that the number of airfoils 242 may be adjusted, as needed, to accommodate for various acoustic and/or vibration considerations, while minimally impacting vaned shroud 210 performance, as previously discussed, so long as the blade-to-blade overlap is sufficiently maintained.

Once the size, radial extent, and number of airfoils 242 are each selected, the airfoils 242 are then properly positioned within the shroud (910). More specifically, as was previously noted, the airfoils 242 are disposed such that the point of lowest radial extent is centered over the main blade impeller leading edge 205. In addition, preferably, though not necessarily, the airfoils 242 are configured such that the airfoil trailing edges 248 do not extend beyond the splitter blade leading edges 209.

In the depicted embodiment, once the airfoil design is settled upon, the inducer area ratio is restored (912). That is, as was discussed previously, the inducer area ratio of the compressor 102 is restored to a value that is substantially equivalent to that of a conventional compressor 102. As was also previously discussed, this can be implemented in any one of numerous ways, including, for example, shroud inner surface re-contour, compressor hubline re-contour, impeller blade angle modifications, impeller blade thickness.

The stiffening ring 614 is appropriately dimensioned and positioned on each of the airfoils 242 (914). In particular, as was previously mentioned, the stiffening ring 614 is positioned so that the stiffening ring leading edge 702 is substantially aligned with the airfoil leading edges 246, and the stiffening ring trailing edge 704 is disposed between the airfoil leading 246 and trailing 248 edges.

Having appropriately designed the vaned shroud 210 for the compressor 102, the shroud 210 with the determined design features may then be manufactured (916). As was previously noted, the shroud 210 is preferably manufactured using an EDM process; however, other processes such as, for example, a casting process, may also be used.

Although the compressor 102 was depicted and described herein as being implemented as a single-stage centrifugal compressor, and in an auxiliary power unit, it will be appreciated that it can also be implemented as various other types of compressors, and in various types of engines, turbochargers, and various other fluid devices, and in various other systems and environments.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A compressor, comprising:

a housing;

an impeller rotationally mounted within the housing and having a plurality of impeller blades, a portion of the impeller defining an inducer having an inducer area ratio;

a shroud at least partially surrounding at least a portion of the impeller, the shroud including at least an inner peripheral surface displaced radially outwardly of the impeller; and a plurality of spaced apart airfoils coupled to, and extending radially inwardly from, the shroud inner peripheral surface, wherein the inducer area ratio is substantially equivalent to that of a compressor having a shroud without the plurality of spaced apart airfoils.

2. The compressor of claim 1, wherein:

the impeller blades each include a leading edge and a trailing edge;

each airfoil extends to point of maximum radial extent from the shroud inner peripheral surface; and the point of maximum radial extent is aligned with the impeller main blade leading edge.

3. The compressor of claim 1, wherein:

each of the airfoils includes a first end and a second end;

each airfoil first end is coupled to the main body inner peripheral surface and has a first thickness;

each airfoil second end has a second thickness; and the first thickness is greater than the second thickness.

4. The compressor of claim 3, further comprising:

a stiffening ring coupled to each of the airfoils and spaced a predetermined distance from the first end of each of the airfoils.

5. The compressor of claim 4, wherein the stiffening ring is coupled to each of the airfoils between each of the airfoil first and second ends.

6. The compressor of claim 4, wherein the stiffening ring includes:

a faceted leading edge; and a faceted trailing edge.

7. The compressor of claim 3, wherein the shroud inner surface includes a constant-radius-section of a predetermined axial length, the constant-radius-section having a substantially constant radius along the predetermined axial length, wherein each of the airfoil first ends is coupled to the constant-radius-section.

8. The compressor of claim 3, wherein each airfoil varies substantially evenly in thickness from the first thickness to the second thickness.

9. A compressor, comprising:

a housing;

an impeller rotationally mounted within the housing and having a plurality of main blades and a plurality of splitter blades, the main blades and the splitter blades each having at least a leading edge and a trailing edge;

a shroud at least partially surrounding at least a portion of the main blades and the splitter blades, the shroud including at least an inner peripheral surface displaced radially outwardly of each of the main blades and splitter blades; and a plurality of spaced apart airfoils coupled to, and extending radially inwardly from, the shroud inner peripheral surface, wherein:

at least a first portion of the shroud inner peripheral surface and each of the splitter blade leading edges define a splitter blade leading edge flow area each airfoil, at least a second portion of the shroud inner peripheral surface, and each of the main blade leading edges defining a main blade leading edge flow area, a ratio of the splitter blade leading edge flow area to the main blade leading edge flow area defines an inducer area ratio, and the inducer area ratio is substantially equivalent to that of a compressor having a shroud without the plurality of spaced apart airfoils.

10. A centrifugal compressor shroud, comprising:

a main body having a first side, a second side, and an inner surface defining a flow passage between the first and second sides;

a plurality of airfoils extending into the main body flow passage, each airfoil having at least a first end and a second end, each airfoil first end coupled to the main body inner surface and having a first thickness, each airfoil second end extending into the main body flow passage and having a second thickness, wherein the first thickness is greater than the second thickness.

11. The shroud of claim 10, further comprising:

a stiffening ring coupled to each of the airfoils and spaced a predetermined distance from the first end of each of the airfoils.

12. The shroud of claim 11, wherein the stiffening ring is coupled to each of the airfoils between each of the airfoil first and second ends.

13. The shroud of claim 11, wherein the stiffening ring includes:

a faceted leading edge; and a faceted trailing edge.

14. The shroud of claim 11, wherein the main body inner surface includes a constant-radius-section of a predetermined axial length disposed between the first and second sides, the constant-radius-section having a substantially constant radius along the predetermined axial length, wherein each of the airfoil first ends is coupled to the main body inner surface airfoil section.

15. The shroud of claim 1, wherein each airfoil varies substantially evenly in thickness from the first thickness to the second thickness.

16. A centrifugal compressor shroud, comprising:

a main body having a first side, a second side, and an inner surface defining a flow passage between the first and second sides, the shroud inner surface including a constant-radius-section of a predetermined axial length disposed between the first and second sides, the constant-radius-section having a substantially constant radius along the predetermined axial length;

a plurality of spaced apart airfoils coupled to, and extending radially inwardly from, the constant-radius-section; and a stiffing ring coupled to each of the airfoils and spaced a predetermined distance from the first end of each of the airfoils, the stiffening ring including at least a faceted leading edge and a faceted trailing edge.

17. The shroud of claim 16, wherein the stiffening ring is coupled to each of the airfoils between each of the airfoil first and second ends.

18. A method of designing a vaned shroud for a compressor having an impeller with a plurality of blades, the vaned shroud having a number of airfoils extending from an inner surface thereof, the method comprising the steps of:

determining an inducer area ratio for a conventional, non-vaned shroud compressor;

determining a radial extent for each of the airfoils;

determining the number of airfoils;

determining axial positions for each of the determined number of airfoils radially around the shroud inner surface; and dimensioning the compressor such that the compressor will have a restored inducer area ratio, the restored inducer area ratio being substantially equivalent to that of the determined inducer area ratio for the conventional, non-vaned shroud compressor.

19. The method of claim 18, wherein the compressor is dimensioned to the restored inducer area ratio by contouring the shroud inner surface at least proximate the splitter blades.

20. The method of claim 18, wherein the impeller blades are coupled to a hub, and wherein the compressor is dimensioned to the restored inducer area ratio by contouring the hub.

21. The method of claim 18, wherein the impeller is dimensioned to the restored inducer area ratio by modifying an angle of the impeller blades.

22. The method of claim 18, wherein the impeller is dimensioned to the restored inducer area ratio by modifying a thickness of the impeller blades.

23. The method of claim 18, further comprising:

determining a shroud inner surface contour that compensates for a reduction in inlet flow area that results from the extension of the airfoils from the shroud inner surface.

24. The method of claim 18, wherein the impeller blades comprise a plurality of main blades and a plurality of splitter blades, the main and impeller blades each having leading edges, the airfoils each include a leading edge, a trailing edge, and a point of maximum radial extent, and wherein the determined axial position is such that:

the point of maximum radial extent is substantially aligned with the main blade leading edges; and the airfoil trailing edges do not extend beyond the splitter blade leading edges.

25. The method of claim 18, further comprising:

determining a position of a stiffening ring that is coupled to, and between, each of the airfoils.

26. The method of claim 25, wherein the airfoils each include a leading edge, a trailing edge, and a point of maximum radial extent, and the determined stiffening ring position is at least between the shroud inner surface and the point of maximum radial extend.

* * * * *